US005438183A

United States Patent [19]

Hayami et al.

[11] Patent Number: 5,438,183

[45] Date of Patent: Aug. 1, 1995

[54] MICROWAVE OVEN INCLUDING ANTENNA FOR RADIATING MICROWAVE

[75] Inventors: Katsuaki Hayami; Hideo Fujii; Yoshihiro Wada; Yoshiharu Omori; Kuniyasu Kubo; Chizuko Konishi; Yoshitsugu Takada, all of Shiga, Japan

[73] Assignee: Sanyo Electric Co., Ltd., Osaka, Japan

[21] Appl. No.: 248,347

[22] Filed: May 24, 1994

[30] Foreign Application Priority Data

| | | | |
|---|---|---|---|
| Jun. 30, 1993 | [JP] | Japan | 5-161916 |
| Jul. 12, 1993 | [JP] | Japan | 5-171567 |
| Aug. 5, 1993 | [JP] | Japan | 5-194814 |
| Aug. 27, 1993 | [JP] | Japan | 5-212804 |

[51] Int. Cl.[6] ..... H05B 6/72

[52] U.S. Cl. ..... 219/748; 219/746

[58] Field of Search ..... 219/748, 749, 746, 747

[56] References Cited

U.S. PATENT DOCUMENTS

| | | | |
|---|---|---|---|
| 3,436,507 | 4/1969 | Püschner | 219/748 |
| 3,814,890 | 6/1974 | Klemp et al. | 219/748 |
| 4,436,973 | 3/1984 | Ikeda et al. | 219/748 |
| 4,496,814 | 1/1985 | Fitzmayer | 219/746 |
| 4,849,592 | 7/1989 | Claesson et al. | 219/749 |

FOREIGN PATENT DOCUMENTS

| | | |
|---|---|---|
| 0079533 | 11/1982 | European Pat. Off. . |
| 2425174 | 5/1978 | France . |
| 53-50122 | 12/1978 | Japan . |
| 62-295386 | 12/1987 | Japan . |
| 1-258343 | 10/1989 | Japan . |
| 2075318 | 4/1981 | United Kingdom . |
| 1193742 | of 0000 | U.S.S.R. . |
| 1141593 | 4/1983 | U.S.S.R. . |

*Primary Examiner*—Philip H. Leung

*Attorney, Agent, or Firm*—Armstrong, Westerman, Hattori, McLeland & Naughton

[57] ABSTRACT

A microwave oven includes a cavity in which food is accommodated, a magnetron for generating microwaves, and a waveguide to supply microwaves generated from the magnetron into the cavity. The waveguide has substantially a truncated cone configuration in which the cross sectional area at the cavity side is greater than the cross sectional area at the magnetron side, and an output antenna of the magnetron is disposed to project from the bottom of the waveguide at the magnetron side into the inner space of the waveguide. The microwave oven further includes a flat radiation antenna fixed in the inner space of the waveguide around the output antenna of the magnetron while maintaining distances from the waveguide and the output antenna of the magnetron in which no spark is generated. Therefore, the radiation area for emitting the microwaves is increased significantly to improve heating nonuniformity within the cavity.

20 Claims, 24 Drawing Sheets

FIG.14A
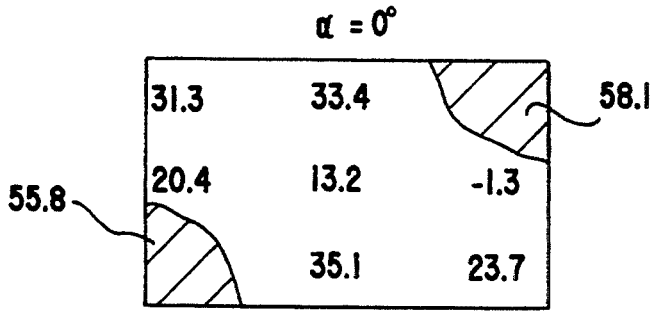
FIG.14B
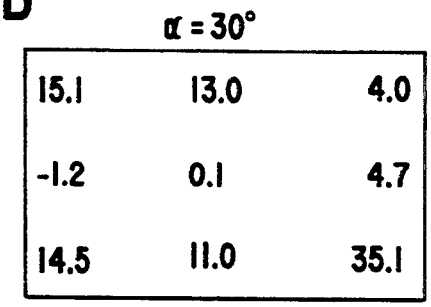
FIG.16
| ANGLE β° | OUTPUT POWER WHEN 2ℓ OF WATER IS HEATED OUTPUT (W) | 150cc OF SAKE IS HEATED | |
|---|---|---|---|
| | | OUTPUT (W) | TEMPERATURE DIFFERENCE IN VERTICAL DIRECTION (deg) |
| 0 | 525 | 245 | 7.6 |
| 20 | 520 | 267 | 7.9 |
| 30 | 523 | 305 | 7.8 |
| 40 | 532 | 328 | 7.2 |

FIG.23

| COUPLING LENGTH | | INPUT / OUTPUT | | | HEATING UNEVENNESS | | NOTE |
|---|---|---|---|---|---|---|---|
| LENGTH OF RIB | RATIO | INPUT(W) | OUTPUT(W) | EFFICIENCY(%) | VERTICAL DIRECTION(deg) | PLANE DIRECTION(deg) | |
| 0.4mm | 1/45 | 1088 | 553 | 50.9 | 14.6 | 7.7 | A |
| 2 | 1/9 | 1095 | 551 | 50.3 | 13.3 | 7.2 | A |
| 3 | 1/6 | 1080 | 558 | 51.7 | 10.8 | 6.1 | A |
| 6 | 1/3 | 1088 | 562 | 51.7 | 10.6 | 6.0 | A |
| 3 | 1/6 | 1098 | 555 | 50.6 | 12.0 | 6.6 | B |

MICROWAVE OVEN INCLUDING ANTENNA FOR RADIATING MICROWAVE

BACKGROUND OF THE INVENTION

1. Field of the Invention

The present invention relates to microwave ovens, and more particularly, to a microwave oven including an antenna for radiating microwaves which realizes uniform heating in a cavity.

2. Description of the Background Art

A conventional microwave oven is disclosed in Japanese Patent Laying-Open No. 62-295386, for example. In this conventional microwave oven, microwaves generated from a magnetron are propagated via a waveguide into a cavity in which a food which is the substance-to-be-heated is accommodated. FIG. 1 is an exploded perspective view showing a structure of a waveguide of such a conventional microwave oven.

Referring to FIG. 1, microwaves generated from an output antenna 101 of a magnetron not shown are propagated within a rectangular waveguide 102. At a sidewall of waveguide 102 in contact with a cavity not shown, a projection portion 103 for coupling having substantially a truncated cone configuration is provided projecting inward the waveguide. A coupling aperture 104 is provided at the center of the top portion of projecting portion 103. A cylindrical radiation antenna 105 is held by a cover 106 of a dielectric material so as to pass through coupling aperture 104.

Such a conventional microwave oven has microwaves emitted into a cavity not shown due to an electric field generated between cylindrical radiation antenna 105 and the sidewall of coupling projection portion 103. The direction of emission is unitary at right angles to the electric field. Because the cross sectional area of the cavity is extremely greater than the opening area of coupling projecting portion 103 at the cavity side, unidirectional microwaves provided to the cavity do not spread out widely within the cavity, resulting in unevenness in heating.

To realize uniform heating within a cavity, a microwave oven including a flat radiation antenna directly secured to the antenna of a magnetron with a screw is disclosed in Japanese Utility Model Publication No. 53-50122, for example. FIG. 2 is an exploded perspective view showing structures of a magnetron and a radiation antenna of such a conventional microwave oven.

Referring to FIG. 2, a flat radiation antenna 113 is attached to an antenna 112 of a magnetron 111 by a screw 114 or the like. A plurality of slits 115 are formed in radiation antenna 113 for enabling energy emission in various modes.

FIG. 3 schematically shows a manner in which microwaves are propagated according to the structure shown in FIG. 2. Referring to FIG. 3, microwaves (indicated by open arrow) are emitted at right angles to an electric field (indicated by general arrow) generated between a cavity 116 and a radiation antenna 113. This range of radiation is limited to that indicated by the broken lines in FIG. 3. This means that nonuniform heating occurs within the cavity.

Furthermore, because radiation antenna 113 is secured to antenna 112 of magnetron 111 by screw 114, a gap may be formed between antenna 112 and radiation antenna 113 as a result of vibration during usage or by insufficient tightening of screw 114 when radiation antenna 113 is reattached after repairment or the like to result in a possibility of a spark occurring in the gap.

SUMMARY OF THE INVENTION

An object of the present invention is to provide a microwave oven capable of reducing nonuniformity in microwave radiation in a cavity to suppress unevenness in heating a food.

Another object of the present invention is to provide a microwave oven capable of preventing generation of a spark between a radiation antenna and an antenna of a magnetron within a cavity.

A further object of the present invention is to provide a microwave oven capable of fine-adjusting the diffusion state of microwaves in a cavity without modifying the basic design of an antenna.

A microwave oven of the present invention includes a cavity, a magnetron, a waveguide, and an antenna for radiation. A substance to be heated is placed in the cavity. The magnetron includes an output antenna for generating microwaves. The waveguide provides microwaves emitted from the output antenna of the magnetron into the cavity. The waveguide has substantially a truncated cone configuration in which the cross sectional area at the cavity side is greater than that of the magnetron side. The output antenna of the magnetron is disposed to project from the magnetron side bottom of the waveguide into the inner space of the waveguide. The antenna for radiating microwaves is fixed within the inner space of waveguide around the output antenna of the magnetron while maintaining distances from the waveguide and the output antenna of the magnetron so that no spark is generated therebetween.

According to another aspect of the present invention, a microwave oven includes a fixed plate of a dielectric material secured to the waveguide, and having an aperture substantially at the center thereof through which the output antenna of the magnetron passes. The radiation antenna is fixed around the aperture of the fixed plate.

According to another aspect of the present invention, the diameter of the aperture is set substantially equal to the diameter of the output antenna of the magnetron.

According to a further aspect of the present invention, the radiation antenna is attached around the aperture on the magnetron side surface of the fixed plate.

According to a still further aspect of the present invention, a portion of the radiation antenna is bent towards at least one of the cavity side and the magnetron side.

According to yet a further aspect of the present invention, the radiation antenna has an aperture at a position off the center thereof through which the output antenna of the magnetron passes.

According to yet another aspect of the present invention, the radiation antenna has an aperture through which the output antenna of the magnetron passes, and a rib all around the perimeter of the aperture and substantially parallel to the output antennal.

According to yet a still further aspect of the present invention, the radiation antenna is fixed inclined with respect to the sidewall of the cavity.

According to an additional aspect of the present invention, an opening is formed at an area on the fixed plate between the outer periphery of the radiation antenna and the outer periphery of the fixed plate so that a straight current path is not generated from the radiation antenna to the waveguide.

According to a further additional aspect of the present invention, the radiation antenna has a flat form.

Because microwaves are emitted by an electric field generated between the output antenna of the magnetron and the radiation antenna and also by an electric field generated between the radiation antenna and the sidewall of the waveguide, the emitting area of microwaves is greater than that of a conventional case where microwaves are emitted only by an electric field generated between the output antenna of the magnetron and the sidewall of the waveguide. Therefore, nonuniformity in the microwave radiation in the cavity can be suppressed, which in turn suppresses unevenness in heating a food product.

Because the radiation antenna is attached on a fixed plate of a dielectric material having an aperture through which an output antenna of the magnetron passes while maintaining constant distances from the waveguide and the output antenna of the magnetron, no spark will occur between radiation antenna and the waveguide and between radiation antenna and the output antenna.

Because the diameter of the aperture of the fixed plate is set substantially equal to that of the output antenna of the magnetron, the fixed plate can be securely fixed after being detached for repairment of the radiation antenna. Therefore, generation of an unnecessary spark can be prevented.

Another advantage of the present invention is that the stain of a food generated during heating can be prevented from adhering to the radiation antenna to prevent generation of an unnecessary spark by fixing the radiation antenna around the aperture on the magnetron side surface of the fixed plate.

A further advantage of the present invention is that nonuniformity in heating can be suppressed by bending a portion of radiation antenna towards at least one of the cavity side and the magnetron side to diffuse microwaves in a more intricated manner within the cavity.

Still another advantage of the present invention is to further improve unevenness in heating by providing an aperture through which the output antenna of the magnetron passes at a position off the center of the radiation antenna to intentionally provide emission of microwaves with directivity.

Because a rib is provided extending all around the perimeter of the aperture which the output antenna of the magnetron passes and substantially in parallel to the output antenna, the microwave coupling between the radiation antenna and the output antenna of the magnetron can be intensified to further improve the microwave emission efficiency of the radiation antenna.

Yet a still further advantage of the present invention is to suppress nonuniformity in heating by fixing the radiation antenna inclined with respect to the sidewall of the cavity to diffuse the microwaves in a more intricated manner in the cavity.

By providing an opening in an area on the fixed plate between the outer periphery of the radiation antenna and the outer periphery of the fixed plate so that a straight current path is not generated from the radiation antenna to the waveguide, the surface resistivity of the fixed plate can be increased even if stain from food is attached to the surface of the fixed plate. Therefore, generation of an unrequired spark can be prevented.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 14A and 14B show the results of a defreezing experiment using the microwave oven of the third embodiment of the present invention.

FIG. 16 shows results of a heating experiment by the microwave oven of FIG. 15.

FIG. 23 is a table showing a result of heating experiment by the microwave oven of the fifth embodiment of the present invention.

DESCRIPTION OF THE PREFERRED EMBODIMENTS

Figure 1:
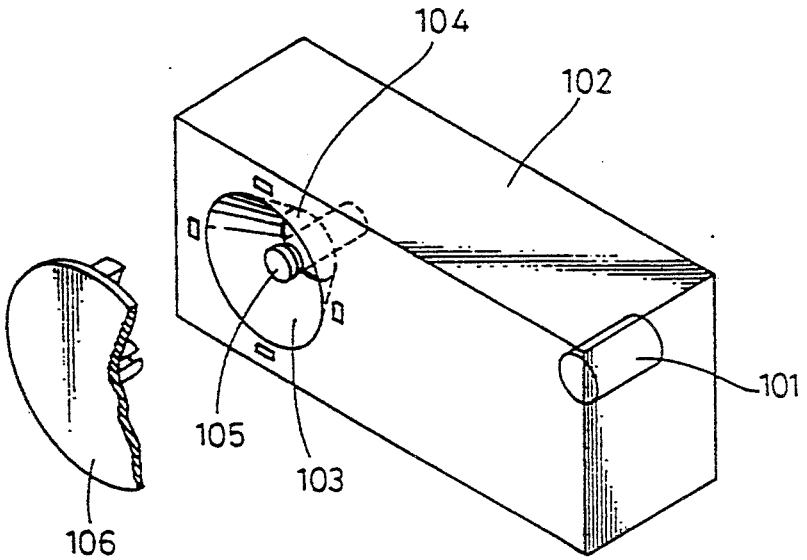
FIG. 1 PRIOR ART
FIG. 1 is an exploded perspective view of one example of a waveguide of a conventional microwave oven.
Figure 2:
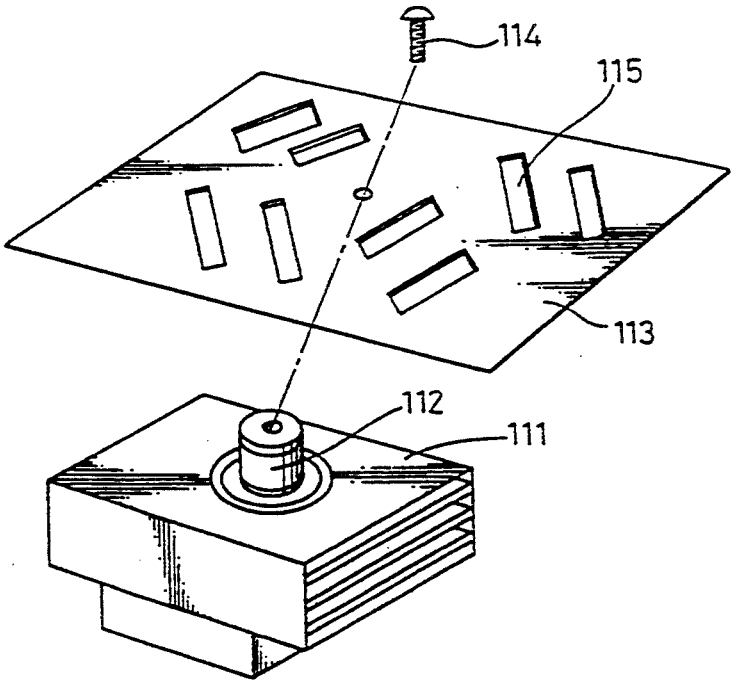
FIG. 2 PRIOR ART
FIG. 2 is an exploded perspective view of one example of a radiation antenna of a conventional microwave oven.
Figure 3:
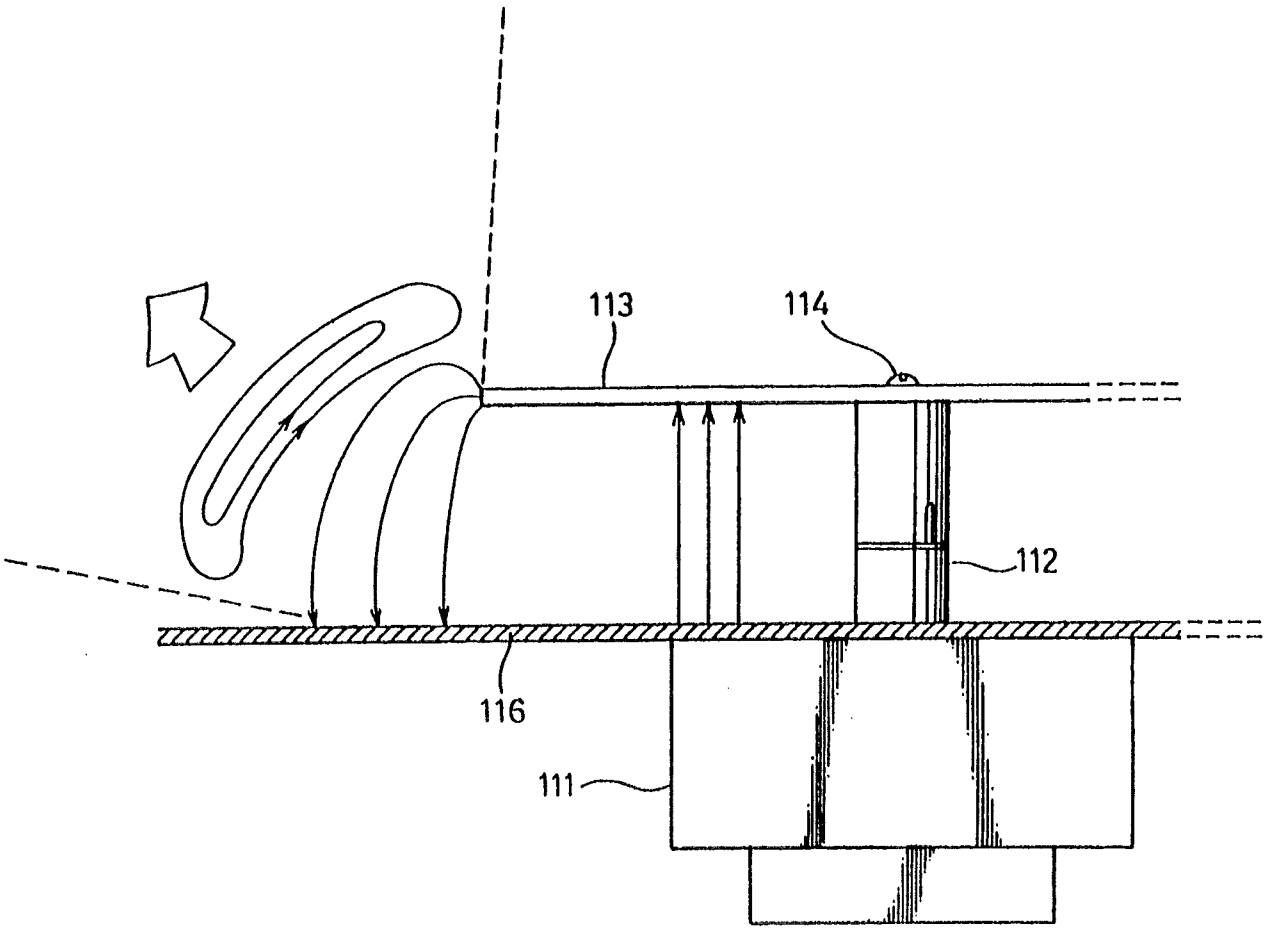
FIG. 3 PRIOR ART
FIG. 3 schematically shows propagation of microwaves from the conventional radiation antenna of FIG. 2.
Figure 4:
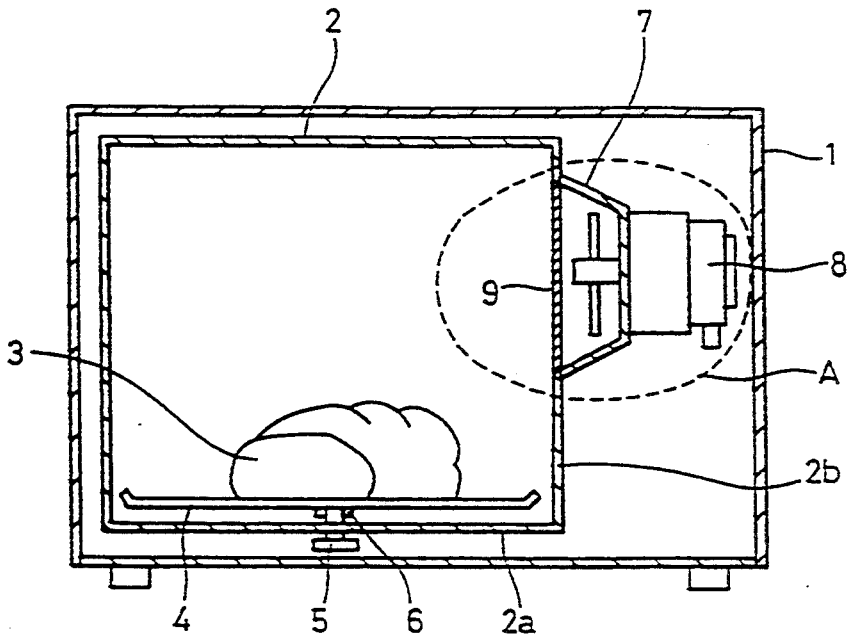
FIG. 4 is a sectional view of a microwave oven according to embodiments of the present invention.

Referring to FIG. 4, a microwave oven according to an embodiment of the present invention includes an outer frame 1, a cavity 2 in which a food 3 to be heated is placed through a front opening (not shown), a turn table 4 rotated during cooking and on which food 3 is placed in cavity 2, a motor 5 for rotating turn table 4, a rotation axis 6 passing through a bottom 2*a* of cavity 2 having one end attached to turn table 4 and the other end attached to motor 5, a waveguide 7 having substantially a truncated cone configuration with an opening at a sidewall 2*b* of cavity 2, a magnetron 8 fixed to the bottom side plane of waveguide 7 opposing the opening, and a protection plate 9 of mica covering the opening of waveguide 7 at sidewall 2*b* of cavity 2.

Waveguide 7 has substantially a truncated cone configuration as described above, wherein the cross sectional area thereof is the largest at the opening at sidewall 2*b* of cavity 2 and it becomes smaller as the distance from sidewall 2*b* becomes larger. The diameter of the bottom side plane most distant from the opening is set to at least 80 mm.

Figure 5:
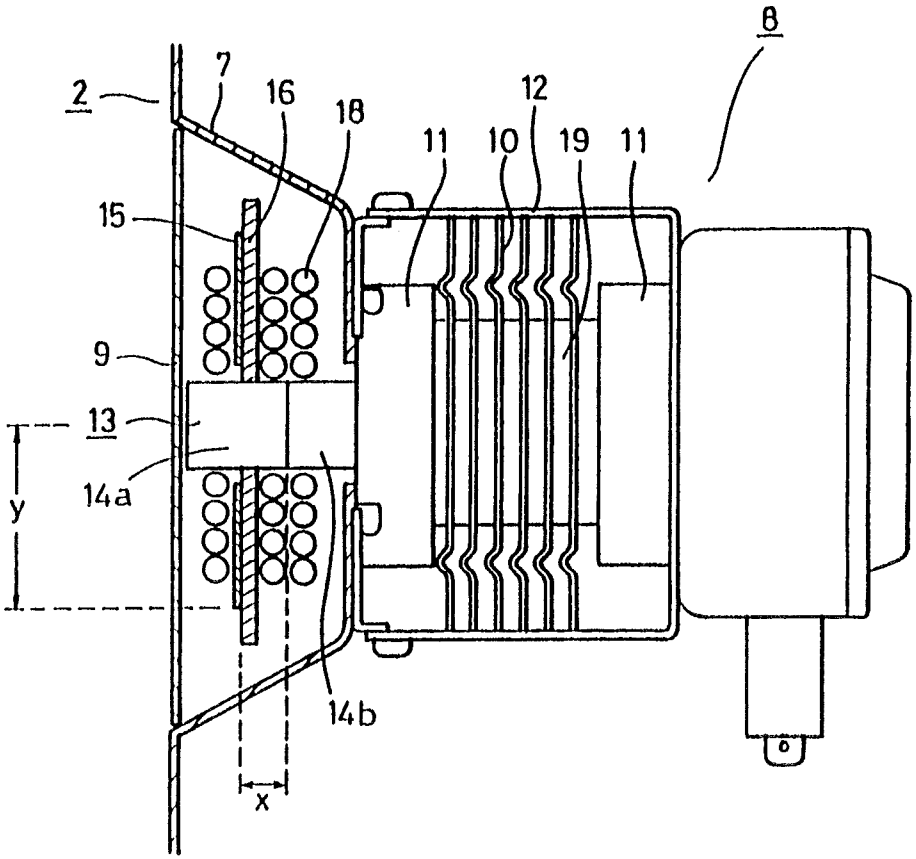
FIG. 5 is a sectional view of the main part of the microwave oven according to the first embodiment of the present invention.

FIG. 5 is an enlarged sectional view of a portion A surrounded by the broken line in FIG. 4. Referring to FIG. 5, magnetron 8 includes a vacuum-tube container 19 with an anode and a cathode not shown, radiation fins 10 fixed by brazing or the like to vacuum-tube container 19, magnets 11, a yoke 12 sandwiching vacuum-tube container 19 and magnets 11 from both sides in the axis direction, and an output antenna 13 projecting from vacuum-tube container 19. Output antenna 13 includes an antenna cap 14*a* provided at one end thereof, and a ceramic insulator barrel 14*b*.

Fixed plate 16 of a dielectric material such as mica is attached perpendicular to the axis direction of output antenna 13 and in contact with antenna cap 14*a*. A flat radiation antenna 15 of a metal such as aluminum is attached on fixed plate 16 with a predetermined distance from antenna cap 14*a*.

Figure 6:
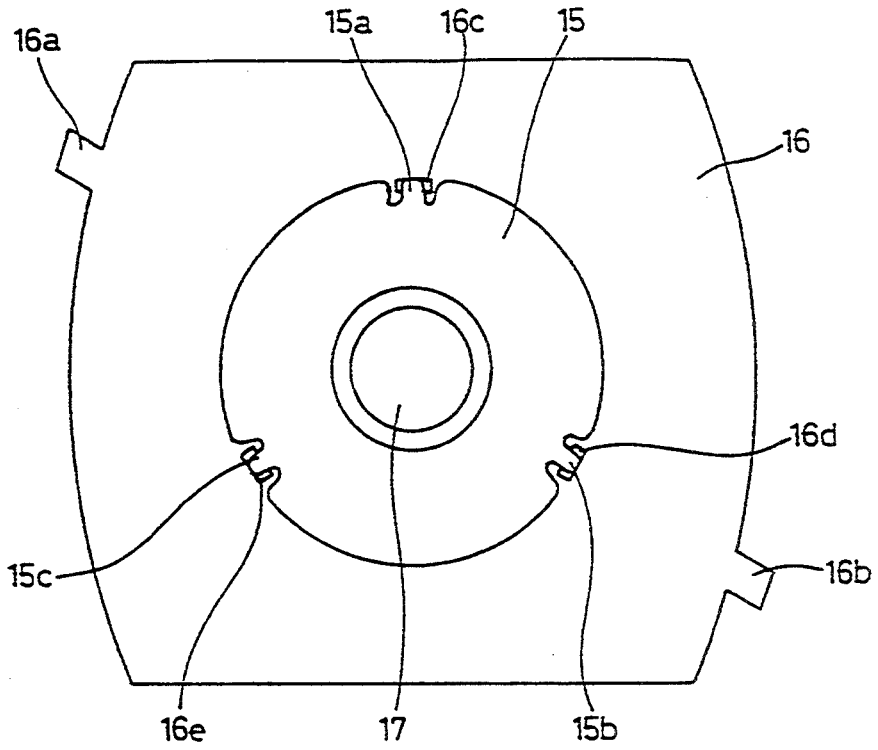
FIG. 6 is a plan view of a radiation antenna according to the first embodiment of the present invention.

FIG. 6 is a plan view of radiation antenna 15 attached on fixed plate 16. Fixed plate 16 has an aperture 17 substantially at the center thereof. Radiation antenna 15 substantially of a donut shape, having an outer perimeter smaller than the outer perimeter of fixed plate 16 and having an inner perimeter greater than the diameter of aperture 17 is fixed around aperture 17. Radiation antenna 15 is attached by inserting ribs 15*a*, 15*b*, and 15*c* formed at a interval of 120° at the perimeter of radiation antenna 15 into mounting holes 16*c*, 16*d* and 16*e* provided in fixed plate 16, respectively. Fixed plate 16 is secured within waveguide 7 by having antenna cap 14*a* inserted in aperture 17 as shown in FIG. 5, and inserting ribs 16*a* and 16*b* formed at the periphery of fixed plate 16 into slits (not shown) formed appropriately at the sidewall of waveguide 7.

The distance between antenna cap 14*a* inserted into aperture 17 and radiation antenna 15 is set to approximately 2 mm so that no spark is not generated therebetween and so as to be coupled efficiently for generating microwaves. Radiation antenna 15 is set sufficiently apart from the sidewall of waveguide 7 at a distance so that a spark does not occur therebetween.

The diameter of aperture 17 of fixed plate 16 is set substantially equal to the diameter of antenna cap 14*a*. Remounting of radiation antenna 15 after dismounting thereof for repairment or the like will be facilitated if the diameter of aperture 17 is greater than that of antenna cap 14*a*. However, this will cause a change in the distance between radiation antenna 15 and antenna cap 14*a* to alter the diffusion state of microwaves in the cavity 2, resulting in nonuniformity in heating, or a possibility of a spark being generated between radiation antenna 15 and the sidewall of waveguide 7. In order to prevent such problems, it is necessary to securely fit antenna cap 14*a* into aperture 17 without any gaps.

Because the temperature inside waveguide 7 becomes high during a heating operation of the microwave oven, a plurality of vent holes 18 for heat emanation are provided at the sidewall of waveguide 7 as shown in FIG. 5. Vent holes 18 are provided on the sidewall, in parallel to the secured radiation antenna 15, and excluding the area corresponding to the proper attached position of radiation antenna 15. More specifically, when viewed from the outer face of waveguide 7 into vent hole 18 with radiation antenna 15 attached to antenna cap 14*a*, radiation antenna 15 will not be visually identified if located at a proper position. Radiation antenna 15 will be visually identified if not attached at a proper position. Therefore, the attached state of radiation antenna 15 can be readily confirmed.

Figure 7:
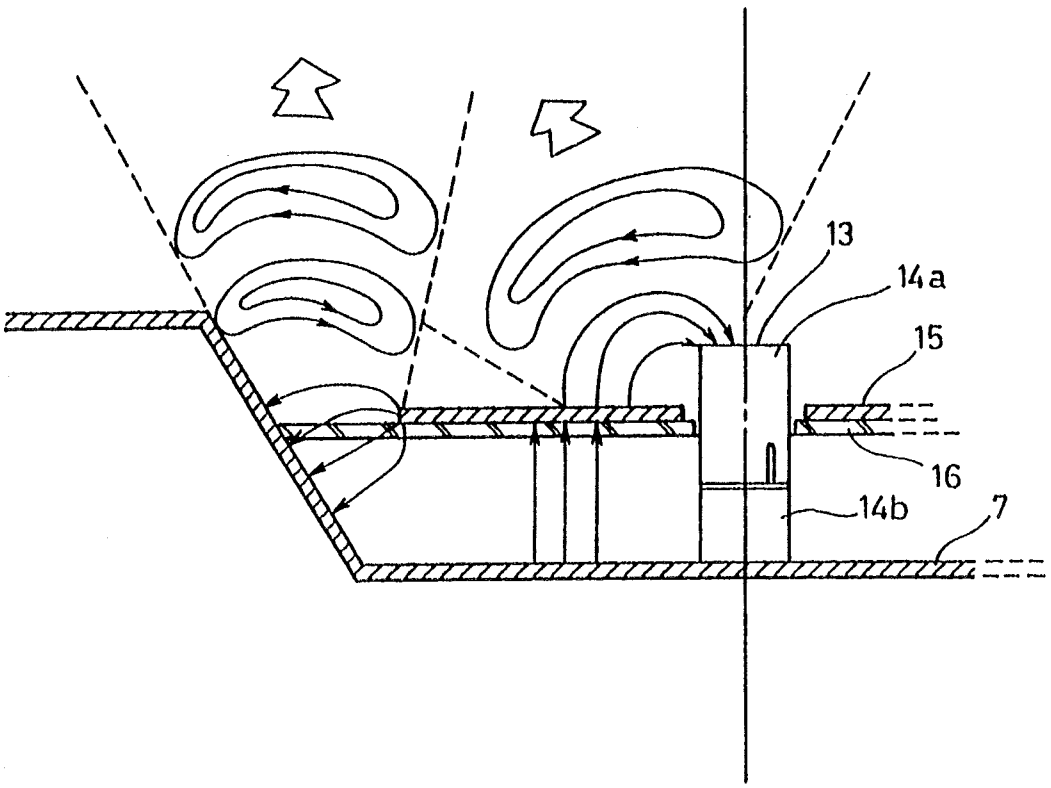
FIG. 7 schematically shows propagation of microwaves by the radiation antenna of the first embodiment of the present invention.

According to the structure shown in FIGS. 5 and 6, an electric field (indicated by a general arrow, FIG. 7,) is generated between output antenna 13 of magnetron 8 and radiation antenna 15 in a heating operation. Microwaves (indicated by open arrow) are emitted at right angles to this electric field, as schematically shown in FIG. 7. An electric field is also generated between radiation antenna 15 and the sidewall of waveguide 7. Microwaves are similarly emitted from this electric field.

In comparison with a conventional microwave oven in which microwaves are emitted only from an electric field between the output antenna of a magnetron and the sidewall of a waveguide, the microwave oven of the first embodiment of the present invention has microwaves emitted from the electric field between output antenna 13 and radiation antenna 15 and also from the electric field between radiation antenna 15 and the sidewall of waveguide 7. Therefore, the emitting area of microwaves is extremely increased, whereby microwaves are emitted into the interior of cavity 2 like water sprinkled out from a shower. Therefore, nonuniformity in radiation of microwaves within cavity 2 is reduced to minimize unevenness in heating.

Referring to FIG. 5, the distance of $(x+y)$, where x is the distance from the magnetron 8 side end of antenna cap 14*a* to radiation antenna 15 and y is the distance from the center of output antenna 13 to the perimeter of radiation antenna 15, i.e. the radius of the outer periphery edge of radiation antenna 15, is set to a value within the range of 35 mm~40 mm.

Figure 8:
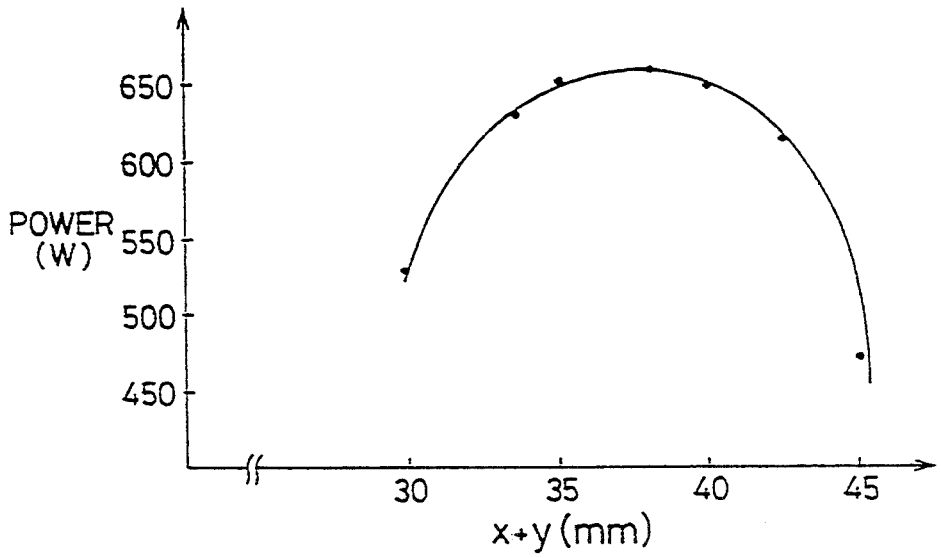
FIGS. 8 and 9 are graphs for describing the effect of the first embodiment of the present invention.
Figure 9:
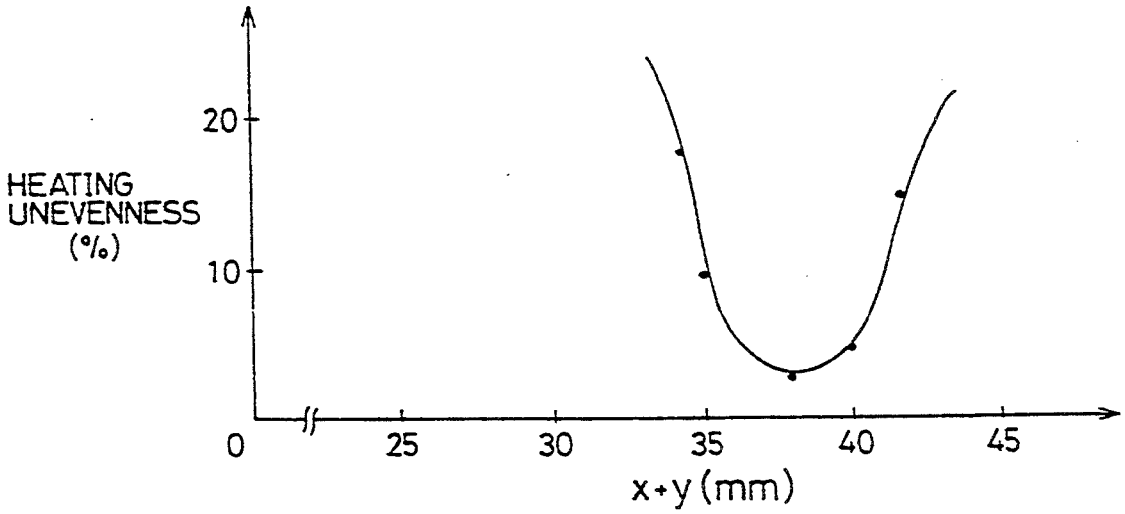

This range is obtained from experimental results shown in FIGS. 8 and 9. FIG. 8 is a graph showing the relationship between microwave power and distance (x+y). A peak in power appears between the distance of 35 mm to 40 mm. It is appreciated that power decreases as an offset from this range. FIG. 9 is a graph showing the relationship between unevenness in heating and distance (x+y). It is appreciated that unevenness in heating is minimum when the distance (x+y) is between 35 mm to 40 mm. From the foregoing, the distance (x+y) is preferably a value between 35 mm to 40 mm.

The experimental result of FIG. 8 was obtained by an experiment using a set of a cavity and a magnetron. The distances of x and y were altered appropriately, and respective power outputs were measured. The experimental result of FIG. 9 was obtained as set forth in the following. Beakers containing water were placed at the four corners and the center on the floor of the cavity. A heating operation was carried out for a predetermined time period. The increase in temperature in each beaker was measured. Then, an average value of the temperature increase in each beaker was obtained, and the difference between the maximum and minimum values of the temperature-increased value was divided by the average value. This was represented in a percentage basis for every distance (x+y), resulting in the graph of FIG. 9.

According to the first embodiment of the present invention, the emitting area of microwaves from a magnetron is increased significantly, whereby nonuniformity in microwave radiation in the cavity can be suppressed to minimize unevenness in heating a food item.

Furthermore, even if radiation antenna 15 is remounted after being removed, the distance between the radiation antenna and the output antenna will not change. Therefore, the possibility of generation of an undesired spark is eliminated.

Radiation antenna 15 according to the above described first embodiment is secured on the surface of fixed plate 16 at the cavity 2 side. Therefore, stains such as the fat, grease, juice evaporated from a food 3 when heating food 3 in cavity 2 are carried into waveguide 7 through the gap between cavity 2 and protection plate 9 to adhere to radiation antenna 15 and the surrounding fixed plate 16. These stains adhering to radiation antenna 15 and fixed plate 16 will become the cause of decreasing the surface resistivity of fixed plate 16. As a result, there is a possibility of a spark occurring between antenna cap 14a of the magnetron and radiation antenna 15, and between radiation antenna 15 and waveguide 7.

Figure 10:
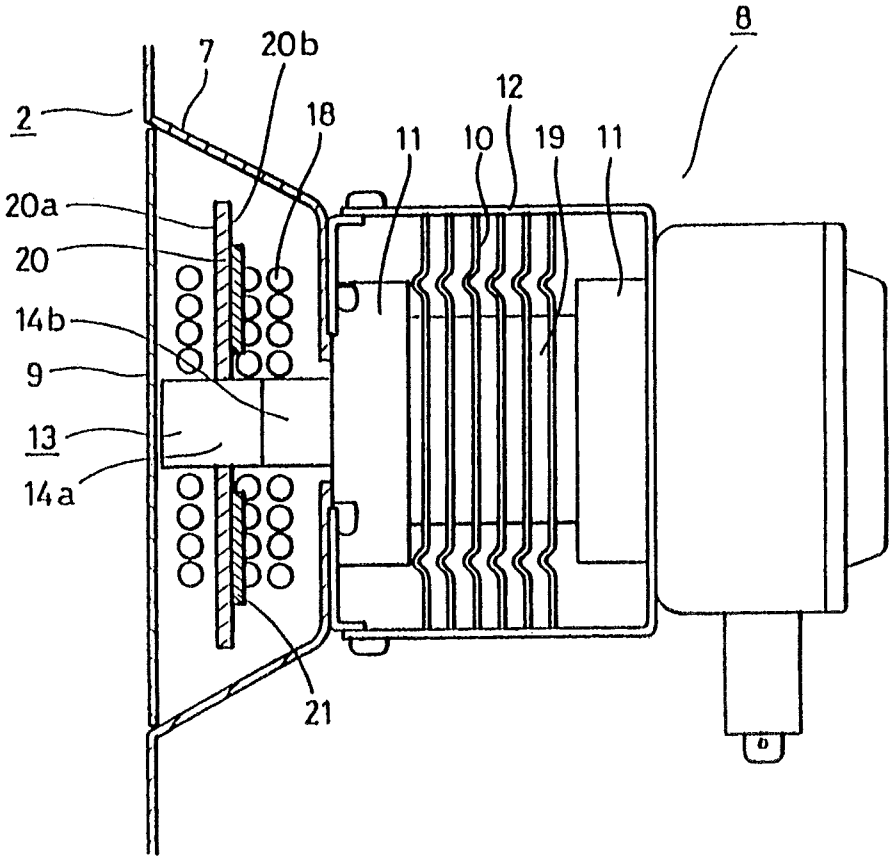
FIG. 10 is a sectional view showing the main part of a microwave oven according to a second embodiment of the present invention.

FIG. 10 is a sectional view showing the main part of a microwave oven according to a second embodiment of the present invention, preventing generation of such a spark. Description of components of the second embodiment in FIG. 10 corresponding to those of the first embodiment of FIG. 5 will not be repeated.

Referring to FIG. 10, a fixed plate 20 of mica having an aperture at substantially the center thereof similar to fixed plate 16 of FIG. 5 is secured within waveguide 7 in a manner similar to that of the first embodiment of Fig. 5. Fixed plate 20 has a plane **20*a* facing the cavity and a plane 20*b* facing the magnetron side. The microwave oven of the second embodiment differs from that of the first embodiment of FIG. 5 in that radiation antenna 21 is attached to plane 20*b* of the magnetron side of fixed plate 20. The secured manner of radiation 21 is similar to that of radiation antenna 15 of FIG. 5**.

Figure 11:
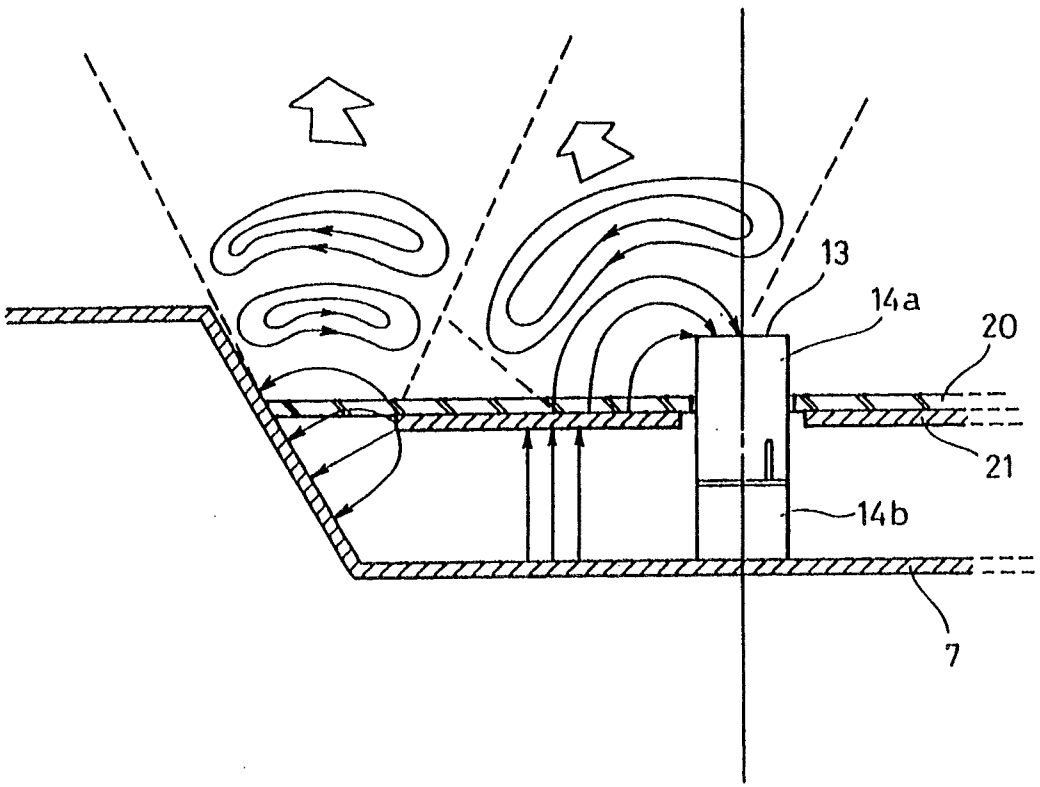
FIG. 11 schematically shows propagation of microwaves by the radiation antenna according to the second embodiment of the present invention.

FIG. 11 schematically shows generation of microwaves in the second embodiment of FIG. 10. Similar to the first embodiment of FIG. 7, a wide emitted area of microwaves can be ensured. The microwave oven of the second embodiment is advantageous over that of the first embodiment in the following point.

According to the structure of the microwave oven shown in FIG. 10, a food 3 is placed in cavity 2, and a heating operation by microwaves is initiated. As a heating operation is carried out, moisture from food 3 will float within cavity 2. If food 3 is meat or the like, fat and grease will be included in the floating moisture. Such floating moisture adhered to the inner wall of cavity 2 will become a stain on the inner surface when the water moisture is dried up. Such moisture will be carried as stains into waveguide 7 from the gap between sidewall **2*b* of cavity 2 and protection wall 9 to adhere to the surface of fixed plate 20**.

The pressure in cavity 2 is higher than that in waveguide 7 due to the high temperature in cavity 2 by heat emanated from food 3 by microwave heating and the tight sealing of cavity 2. Therefore, the air in waveguide 7 will flow towards the magnetron side from the cavity side, whereby moisture is also carried from the cavity side to the magnetron side. Thus, moisture will seldom adhere to face **20*b* of the magnetron side even if moisture will adhere to face 20*a* of the cavity side of fixed plate 20**.

Thus, generation of a spark due to reduction of a surface resistivity of face **20*b* of fixed plate 20 can be prevented because stains from the food floating together with moisture will not adhere to radiation antenna 21 secured to face 20*b* of the magnetron side of fixed plate 20 and also to the surrounding face 20*b* of fixed plate 20**.

Figure 12:
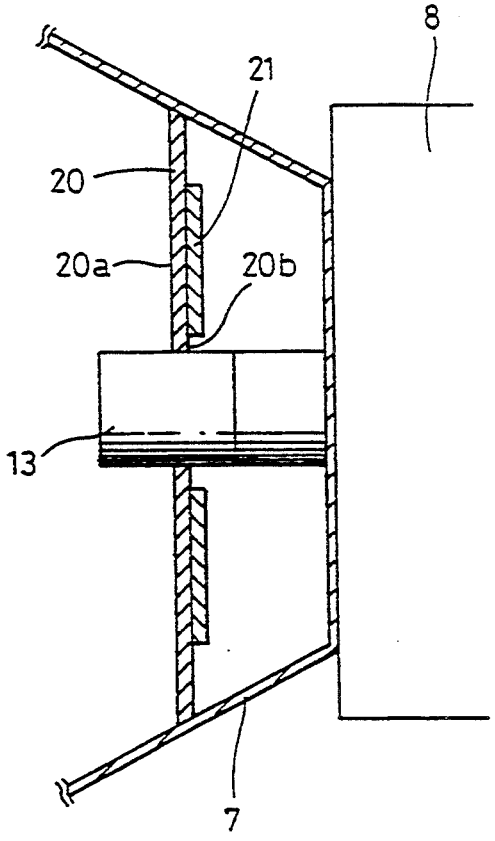
FIG. 12 is a sectional view of the main part showing a modification of the second embodiment of FIG. 10.

An approach could be taken to improve the heat maintaining ability within the cavity and prevent heat from escaping by separating the inner space of waveguide 7 completely with fixed plate 20 as shown in FIG. 12 so as to provide a chamber partitioned by protection plate 9 and fixed plate 20 and a chamber partitioned by fixed plate 20 and the bottom side plane of waveguide 7, in order to carry out grill cooking by means of a heater (not shown) in cavity 2. Adhesion of stains onto face **20*b* of the magnetron side of fixed plate 20** can be further prevented by employing such a structure.

According to the above second embodiment of the present invention, the attachment of a radiation antenna to the magnetron side surface of a fixed plate provides the advantage of preventing adhesion of stains such as fat from heated food onto the radiation antenna and a fixed plate therearound. As a result, generation of a spark can be prevented between the radiation antenna and the output antenna of the magnetron, and between the radiation antenna and the waveguide.

In the above described first and second embodiments, radiation antenna 15 (or 21) is fixed in a manner parallel to sidewall **2*b* of cavity 2. Therefore, microwaves emitted from the entire circumference of radiation antenna 15 are reflected similarly in waveguide 7 to be diffused into cavity 2**.

However, there are cases when unevenness in heating food cannot be improved to a sufficient level with such a uniform diffusion. In order to diffuse microwaves suitable for cooking, it is sometimes necessary to intentionally induce nonuniformity in microwaves within the cavity. When the secured position of the radiation antenna has been eventually determined in a designing stage, the secured position of the radiation antenna can no longer be moved in the forward or backward direction. It was therefore difficult to carry out fine-adjustment of intentional microwave radiation nonuniformity in the cavity.

Figure 13:
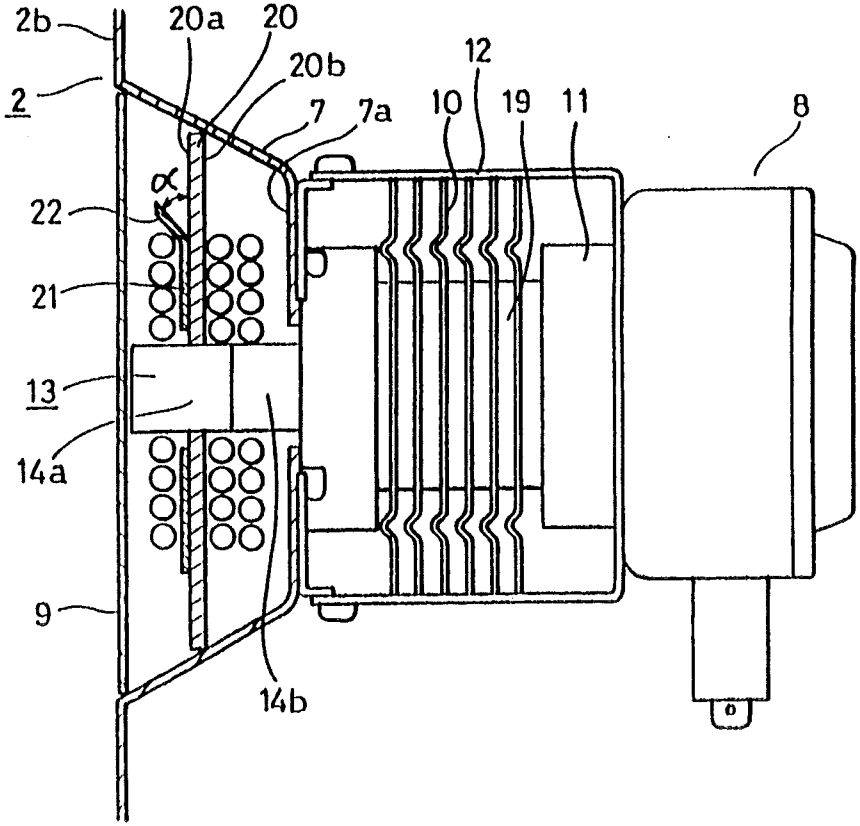
FIG. 13 is a sectional view of the main part of a microwave oven according to a third embodiment of the present invention.

FIG. 13 is a sectional view of the main part of a microwave oven according to a third embodiment of the present invention allowing fine-adjustment of the diffusion state of microwaves in the cavity. Description of components in the third embodiment of FIG. 13 corresponding to those of the first and second embodiments shown in FIGS. 5 and 10 will not be repeated.

Referring to FIG. 13, a fixed plate 20 having an aperture approximately at the center is provided within a waveguide 7 in a manner substantially parallel to the wall face 2b of cavity 2, similar to fixed plate 16 of FIG. 5. A flat antenna 21 for radiating microwaves is fixed on a face 20a of fixed plate 20 at the cavity side. Radiation antenna 21 includes an antenna bending portion 22 bent towards cavity 2. Antenna bending portion 22 is formed as an arc of approximately ¼ the diameter of radiation antenna 21 in length bent from the outer periphery of radiation antenna 21 to the center thereof at an angle of $\alpha°$ (for example, approximately 30°) with respect to face 20a.

Similar to the first embodiment of FIG. 5, the microwave oven of the structure of FIG. 13 has electric fields generated respectively between antenna cap 14a of magnetron 8 and radiation antenna 21, and between radiation antenna 21 and the sidewall of waveguide 7, whereby microwaves are emitted towards cavity 2. Because a portion of radiation antenna 21 is bent, the distance between sidewall 2b of cavity 2 and the outer periphery of radiation antenna 21 differs in antenna bending portion 22 and the other portion.

Therefore, microwaves propagate into cavity 2 with the direction of microwaves emitted from bending portion 22 of radiation antenna 21 closer to cavity 2 being different from the direction of microwaves emitted from other portions of radiation antenna 21 distant from cavity 2.

As a result, microwave are propagated in an intricated manner within cavity 2 to realize a diffused state of microwaves suitable for cooking. Therefore, unevenness in heating food can be improved.

FIG. 14 shows the temperatures measured at various places when a mass of frozen sliced beef is thawed for approximately 10 minutes at a power of 200W. In FIG. 14, (a) shows temperatures when antenna bending portion 2 was not provided in radiation antenna 21, i.e. $\alpha=0°$, and (b) shows the case where antenna bending portion 22 is provided, i.e. $\alpha=30°$.

By comparing the temperature measured results shown in 14A and 14B, it is appreciated that the temperatures at the upper right and bottom left corner in 14A are high in comparison with other places, resulting in excessive heating. This excessive heating is not seen in 14B having an antenna bending portion 22 provided. The temperatures in various places in 14B are substantially equalized in comparison with the result of 14A. It is appreciated by the results of these experiments that unevenness in heating in the plane direction in the cavity is improved by bending a portion of radiation antenna towards cavity 2.

Figure 15:
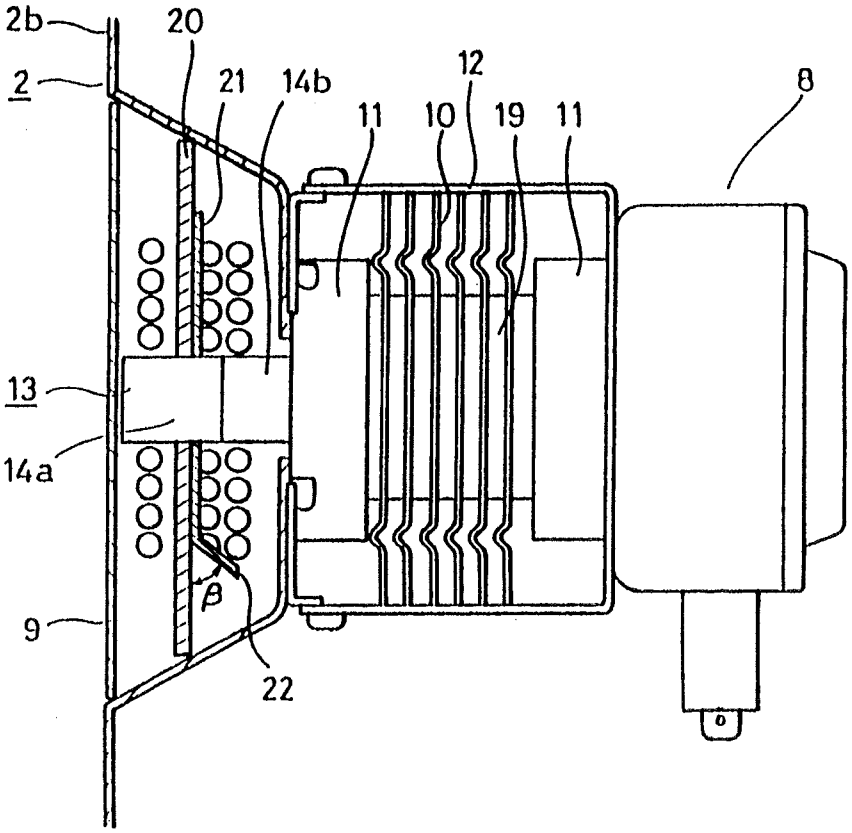
FIG. 15 is a sectional view showing the main part of one modification of the radiation antenna of the third embodiment of the present invention.

The position of antenna bending portion 22 at the outer periphery edge of radiation antenna 21 is not limited to that shown in FIG. 15. Antenna bending portion 22 may be provided in any position at the outer periphery edge of radiation antenna 21.

As a modification of the embodiment shown in FIG. 13, an antenna bending portion 22 of radiation antenna 21 may be bent towards magnetron 8, as shown in FIG. 15. Referring to FIG. 15, a radiation antenna 21 is fixed to face 20b of the magnetron side of fixed plate 20. Bending portion 22 is an arc of approximately ¼ the diameter of radiation antenna 21 in length from the outer periphery of radiation antenna 21 to the center thereof bent towards magnetron 8 at an angle of $\beta°$ from face 20b.

FIG. 16 is a table showing the relationship between angle $\beta°$ and the output power when 2 liter of water in a bottle is heated, and the relationship among angle $\beta°$, the output power, and the temperature difference between the upper portion and the lower portion (temperature nonuniformity) of a bottle containing 150 cc of sake heated for 76 seconds.

It is appreciated from the table of FIG. 16 that there is no significant change in the output power in response to angle $\beta°$ when 2 liter of water is heated. In contrast, the heat output with respect to 150 cc of sake increases as the bending angle $\beta°$ of antenna bending portion 22 becomes greater. This means that the provision of an antenna bending portion 22 as shown in FIG. 15 is suitable for increasing power with respect to a substance-to-be-heated of light load. However, unevenness in heating in the vertical direction is not improved by provision of bending portion 22.

Figure 17:
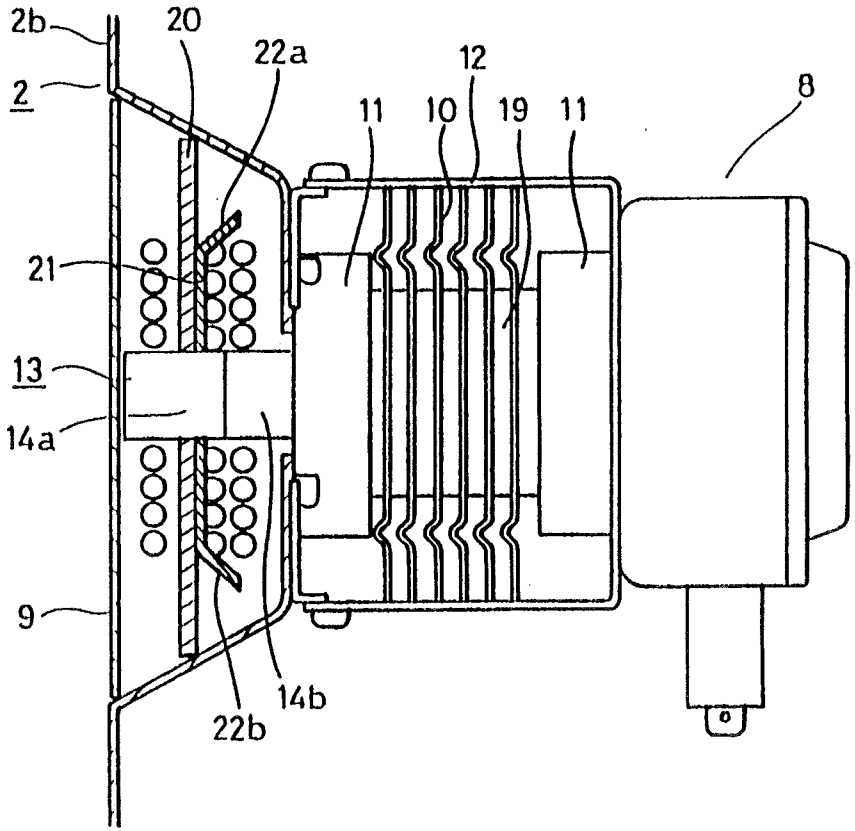
FIG. 17 is a sectional view showing the main part of another modification of the radiation antenna of the third embodiment of the present invention.

A bending portion may be provided not only in one side of radiation antenna 21, but at both sides of radiation antenna 21, as shown in FIG. 17. Referring to FIG. 17, two antenna bending portions 22a and 22b are bent towards magnetron 8 at an angle of $\beta°$ with respect to face 20b of fixed plate 20.

Figure 18:
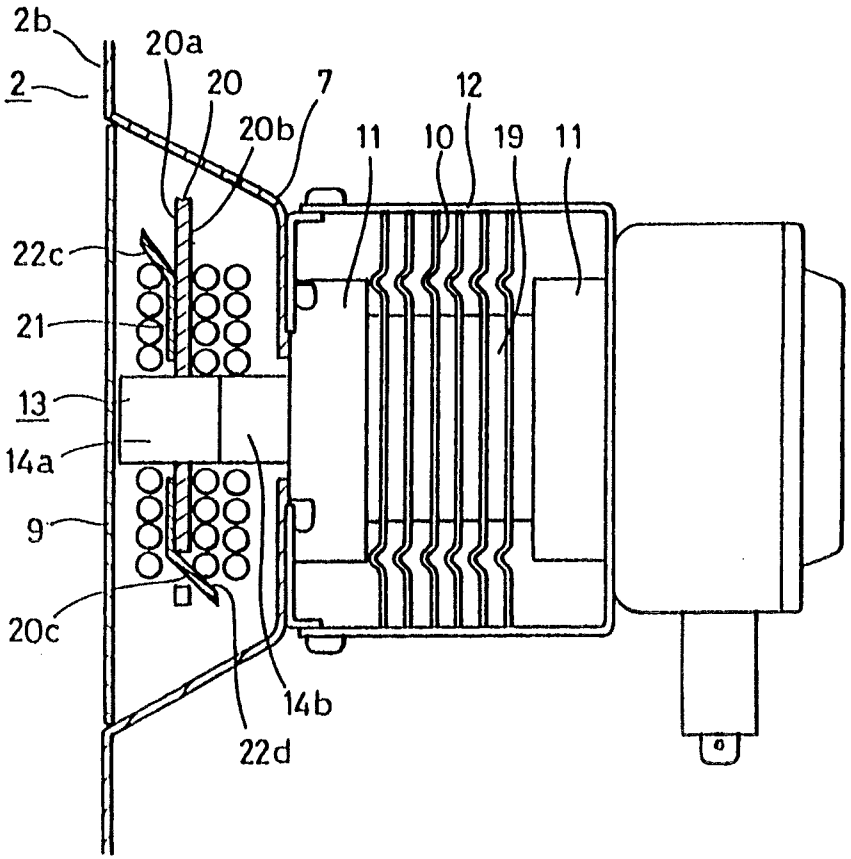
FIG. 18 is a sectional view showing the main part of further modification of the third embodiment of the present invention.

FIG. 18 shows a radiation antenna 21 which has a configuration of a combination of FIGS. 13 and 15. Viewed from cavity 2 side, an antenna bending portion 22c which is a left arc of radiation antenna 21 is bent towards cavity 2 by an angle of $\alpha°$ with respect to face 20a of fixed plate 20, and an antenna bending portion 22d which is a right arc of radiation antenna 21 is bent towards magnetron 8 by an angle of $\beta°$ with respect to face 20b of fixed plate 20. By including both features, the output characteristics with respect to light load and unevenness in heating in the plane direction of the cavity can both be improved.

Radiation antenna 21 of FIG. 18 is secured on face 20a of fixed plate 20 at the cavity 2 side by passing the right antenna bending portion 22d through a slit 20c provided at the proximity of the periphery edge of fixed plate 20.

Even if the structural designing of a microwave oven is completed and the fixed position of radiation antenna 21 is eventually determined, the third embodiment of the present invention allows modification of the heating unevenness pattern by just adjusting the bending angles of $\alpha$ and $\beta$ of antenna bending portion 22 to compensate for change in the pattern of heat unevenness in cavity 2 caused by a slight modification in the configuration of cavity 2 for reinforcement or the like. Thus, heating unevenness can be improved without a significant change in designing.

Figure 19:
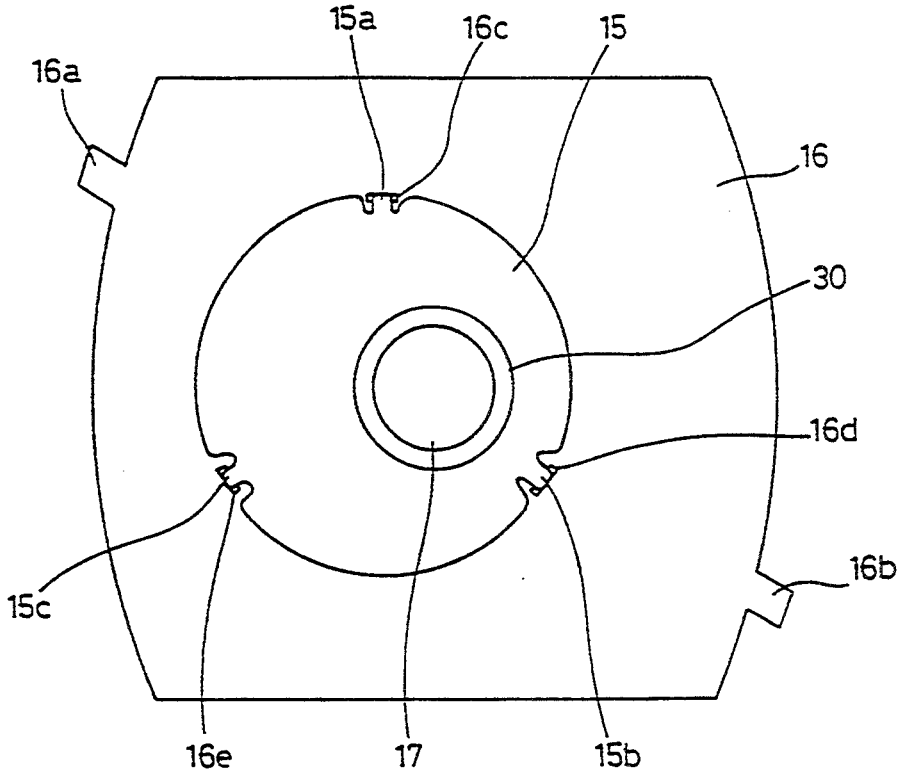
FIG. 19 is a plan view of a radiation antenna according to a fourth embodiment of the present invention.
Figure 20:
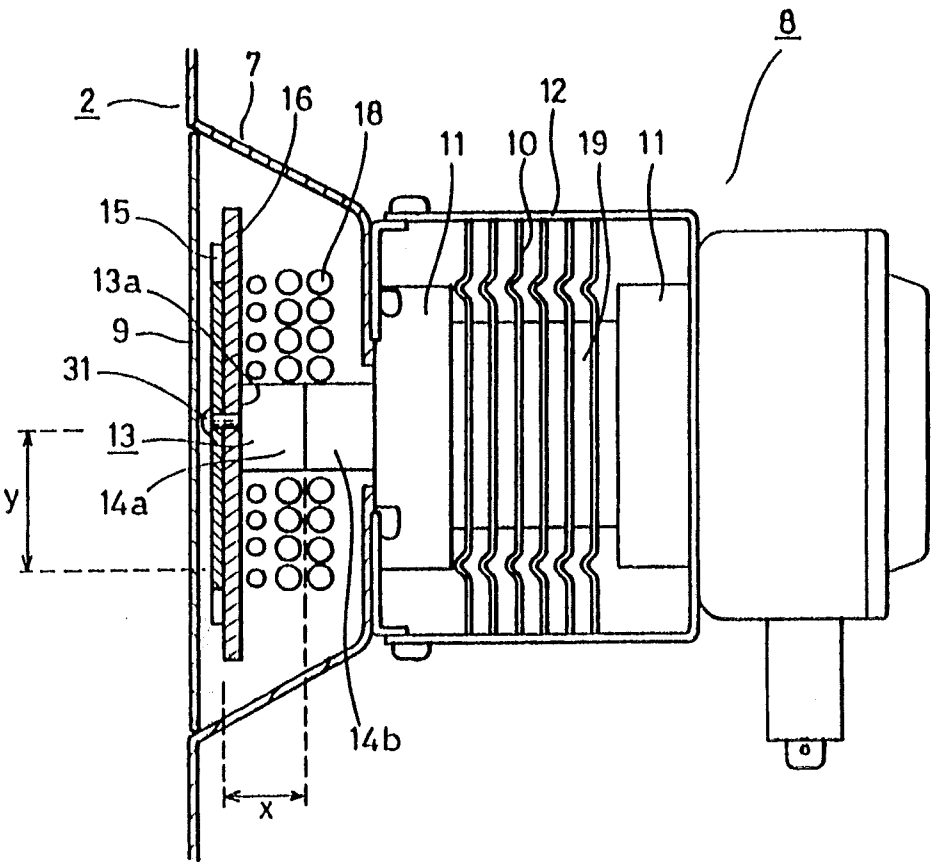
FIG. 20 is a sectional view showing the main part of one modification of the fourth embodiment of the present invention.

FIG. 19 is plan view of a radiation antenna of a microwave oven according to a fourth embodiment of the present invention. The radiation antenna of FIG. 19 differs from the radiation antenna of the first embodiment shown in FIG. 6 as set forth in the following. Radiation antenna 15 of FIG. 19 has an aperture 30 displaced rightwards from the center thereof. Radiation antenna 15 is secured to fixed plate 16 so that the center of aperture 30 coincides with the center of aperture 17 provided at the center of fixed plate 16.

As already described in conjunction with FIG. 8, the relationship between distance (x+y), where x is the distance from the end portion of antenna cap 14*a* at magnetron 8 side to radiation antenna 15 and y is the distance from the center of output antenna 13 to the outer periphery of radiation antenna 15, and microwave output changes as shown in FIG. 8. Therefore, by displacing aperture 30 of radiation antenna 15 from the center thereof as shown in FIG. 19, output will not be emitted uniformly from the entire perimeter of radiation antenna 15.

More specifically, microwaves can be emitted with directivity as a whole by fixing output antenna 13 at a position displaced from the center of radiation antenna 15 to provide portions differing in microwave emission level.

Even if the configuration of the cavity is slightly modified after the structure designing stage of a microwave oven is completed, the fourth embodiment of the present invention allows the microwave diffusion state within a cavity to be intentionally displaced easily by adjusting the eccentricity of the center of radiation antenna 15 with respect to the center of output antenna 18 of the magnetron. As a result, the heating unevenness of food can be improved. Also the time required for heating can be reduced.

In the embodiment shown in FIG. 19, radiation antenna 15 is secured to fixed plate 16 which is fixedly held by antenna 13 of magnetron 8 inserted into aperture 17. Alternatively, a tapped hole may be formed in the center of fixed plate 16 and a top portion 13*a* of antenna 13 to insert a screw 31 therein to secure fixed plate 16 to antenna 13 instead of forming aperture 17 in fixed plate 16.

Figure 21:
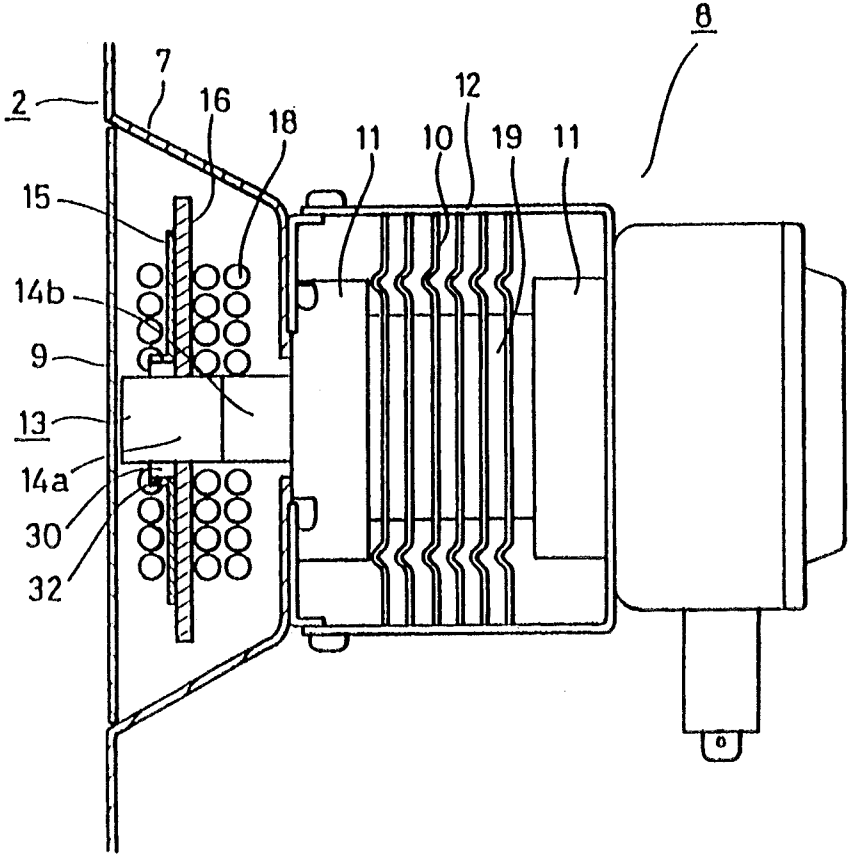
FIG. 21 is a sectional view showing the main part of a microwave oven according to a fifth embodiment of the present invention.
Figure 22:
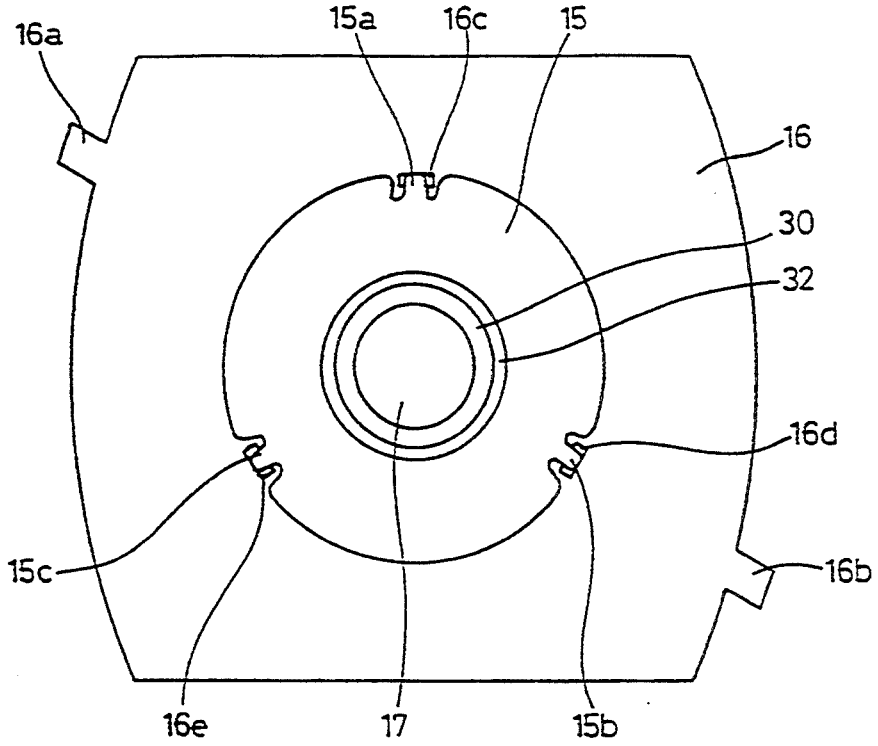
FIG. 22 is a plan view of a radiation antenna according to the fifth embodiment of the present invention.

FIG. 21 is a sectional view of the main part of a microwave oven according to a fifth embodiment of the present invention. FIG. 22 is a plan view of a radiation antenna used therein. The microwave oven according to the fifth embodiment shown in FIGS. 21 and 22 is similar to that of the first embodiment shown in FIGS. 5 and 6 provided that a rib 32 is formed extending towards cavity 2 and in parallel to antenna cap 14*a* around the entire perimeter of aperture 30 formed at the center of radiation antenna 15. According to the fifth embodiment of the present invention, an electric field is generated between output antenna 13 of magnetron 8 and rib 32 of radiation antenna 15 in addition to the electric field generated in the microwave oven of the first embodiment in a heating operation.

FIG. 23 is a table showing the relationship among the length ratio of rib 32 of radiation antenna 15 to antenna cap 14*a* of magnetron 8, input/output power, and heating unevenness.

It is appreciated from the table of FIG. 23 that the heating efficiency and heating uneveness can be improved by setting each dimension so that the ratio of the length of rib 32 of radiation antenna 15 to the length of antenna cap 14*a* of magnetron 8 is greater than 1/6.

In the column of "Note" in the table of FIG. 23, A implies that rib 32 protrudes from radiation antenna 15 towards cavity 2, and B implies that rib 32 protrudes towards magnetron 8. It is appreciated from this table that both heating efficiency and heating unevenness are more improved in the case of A.

Heating unevenness in the plane direction within the cavity was measured as follows. Beakers each containing 100 cc of water were placed in pairs at an interval of $\frac{1}{4}$ wavelength on the turntable to be subjected to heating for 3 minutes and 30 seconds at 200 W. The rise in temperature in each beaker was measured by which the minimum value was substrated from the maximum value to be used as the measured results.

According to the fifth embodiment of the present invention, microwaves emitted from output antenna 13 of magnetron 8 are received by radiation antenna 15. Because rib 32 of radiation antenna 15 provided substantially parallel to and around the entire perimeter of antenna 13 is located in the proximity of the antenna with a large opposing area, leakage of microwaves is minimized, resulting in a more intensive microwave coupling between output antenna 13 of magnetron 8 and radiation antenna 15 for generating microwaves. Thus, microwaves can be emitted efficiently from radiation antenna 15 to improve heating efficiency and heating unevenness.

In the above-described embodiments, radiation antenna 15 is fixed basically parallel to sidewall 2*b* of cavity 2, so that microwaves emitted from the entire circumference of radiation antenna 15 are reflected similarly in waveguide 7 to be diffused within cavity 2.

Considering heating unevenness in the vertical direction, merely shifting the attached position of the radiation antenna in the axis direction of output antenna 13 may just alter the region of heating unevenness, and may not improve the generation of heating unevenness per If the mass of the food to be heated is great, the microwaves absorbed by the food will be increased, so that heating unevenness in the vertical direction is not so noticeable. In heating food of a small mass, for example sake or milk, however, the amount of microwaves not absorbed by the food and therefore diffused into cavity 2 is great. Accordingly, heating unevenness will become significant.

Figure 24:
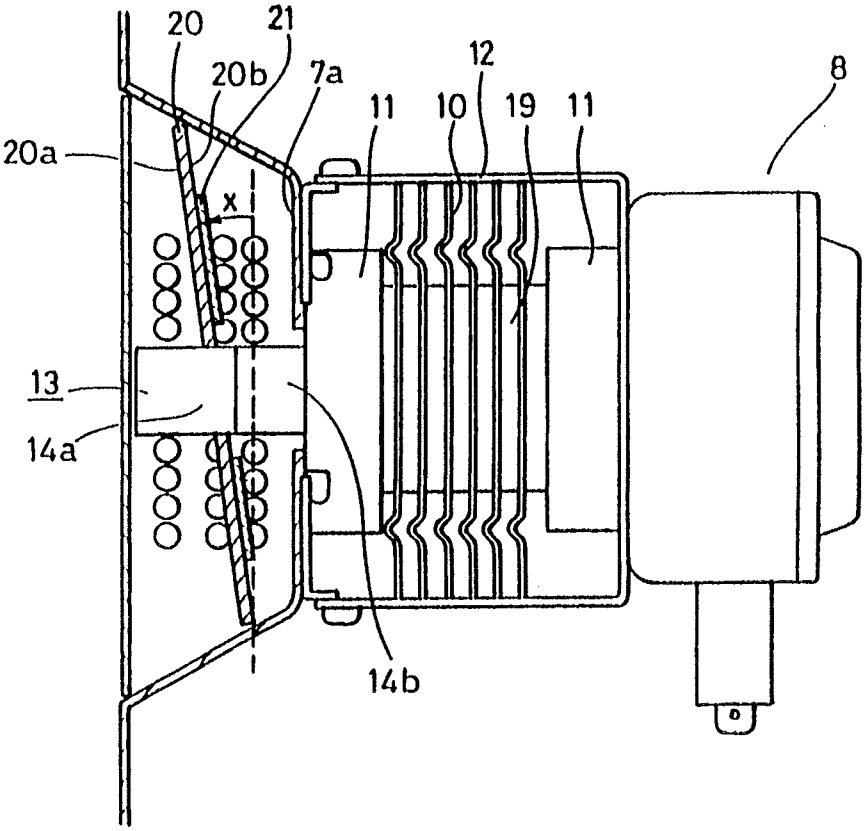
FIG. 24 is a sectional view showing the main part of a microwave-oven according to a sixth embodiment of the present invention.

FIG. 24 is a cross sectional view showing the main part of a microwave oven according to a sixth embodiment of the present invention which is aimed to improve such heating unevenness in the vertical direction. The microwave oven according to the sixth embodiment of the present invention shown in FIG. 24 differs from that of the second embodiment shown in FIG. 10 as set forth in the following. A fixed plate 20 having an aperture 30 is secured to waveguide 7 in a manner inclined towards cavity 2 (direction of x in figure) by an angle of approximately 30° with respect to sidewall 2*b* of cavity 2, with a face 20*a* towards cavity 2 and a face 20*b* towards magnetron 8. Flat radiation antenna 21 secured to face 20*b* of fixed plate 20 at the magnetron 8 side has an opening 34 of substantially an ellipse shape at the center thereof greater than aperture 30 of fixed plate 20, as shown in FIG. 25.

If the shape of opening 34 is identical to that of the opening of radiation antenna 15 of the first embodiment of FIG. 6, i.e. a true circle, the distance between output antenna 13 and radiation antenna 21 will not be constant around the entire perimeter when radiation antenna 21 with fixed plate 20 is secured in an inclining manner to output antenna 13 of magnetron 8. For example, if the most remote distance between output antenna 13 and radiation antenna 21 is 2 mm which provides the optimum coupling efficiency, there is a possibility of a spark occurring in other regions between output antenna 13 and radiation antenna 21 which are closer in distance. If the shortest distance between output antenna 13 and radiation antenna 21 is set to 2 mm to avoid occurrence of such a spark, efficient microwave coupling cannot be achieved at other regions between output antenna 13 and radiation antenna 21 due to its greater distance. By providing an ellipse-shaped opening 34 as shown in FIG. 25, the distance between output antenna 13 and radiation antenna 21 can be kept constant.

Figure 25:
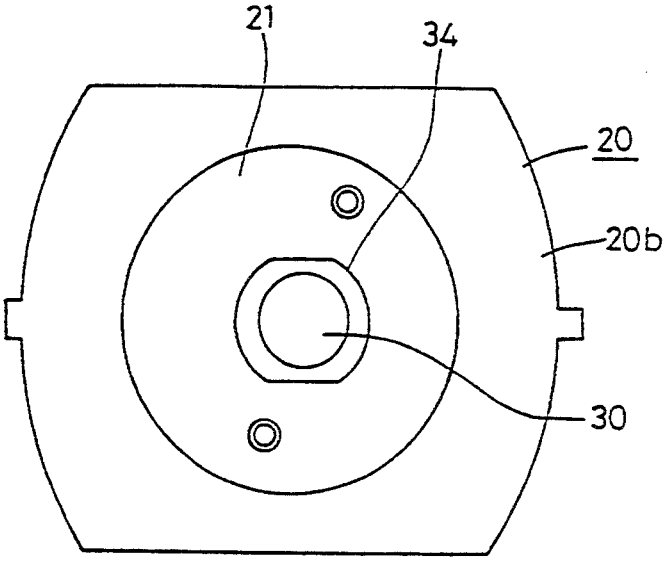
FIG. 25 is a plan view of a radiation antenna according to the sixth embodiment of the present invention.

According to the structure of a microwave oven shown in FIGS. 24 and 25, an electric field is generated between antenna cap 14*a* and radiation antenna 21 of magnetron 8, and also between radiation antenna 21 and the sidewall of waveguide 7, whereby microwaves are emitted towards cavity 2. The distance from sidewall 2*b* of cavity 2 to the outer periphery of radiation antenna 21 is not constant along the circumference since radiation antenna 21 is fixed in an inclined manner as shown in FIG. 24. Therefore, microwaves emitted from radiation antenna 21 close to cavity 2 are directly propagated to cavity 2, whereas microwaves emitted from radiation antenna 21 remote from cavity 2 are reflected at the sidewall of waveguide 7 to be propagated to cavity 2 in a direction differing from that of the above described microwaves.

As a result, microwaves are diffused in an intricated manner, whereby heating unevenness with respect to food will be further improved.

Figure 26:
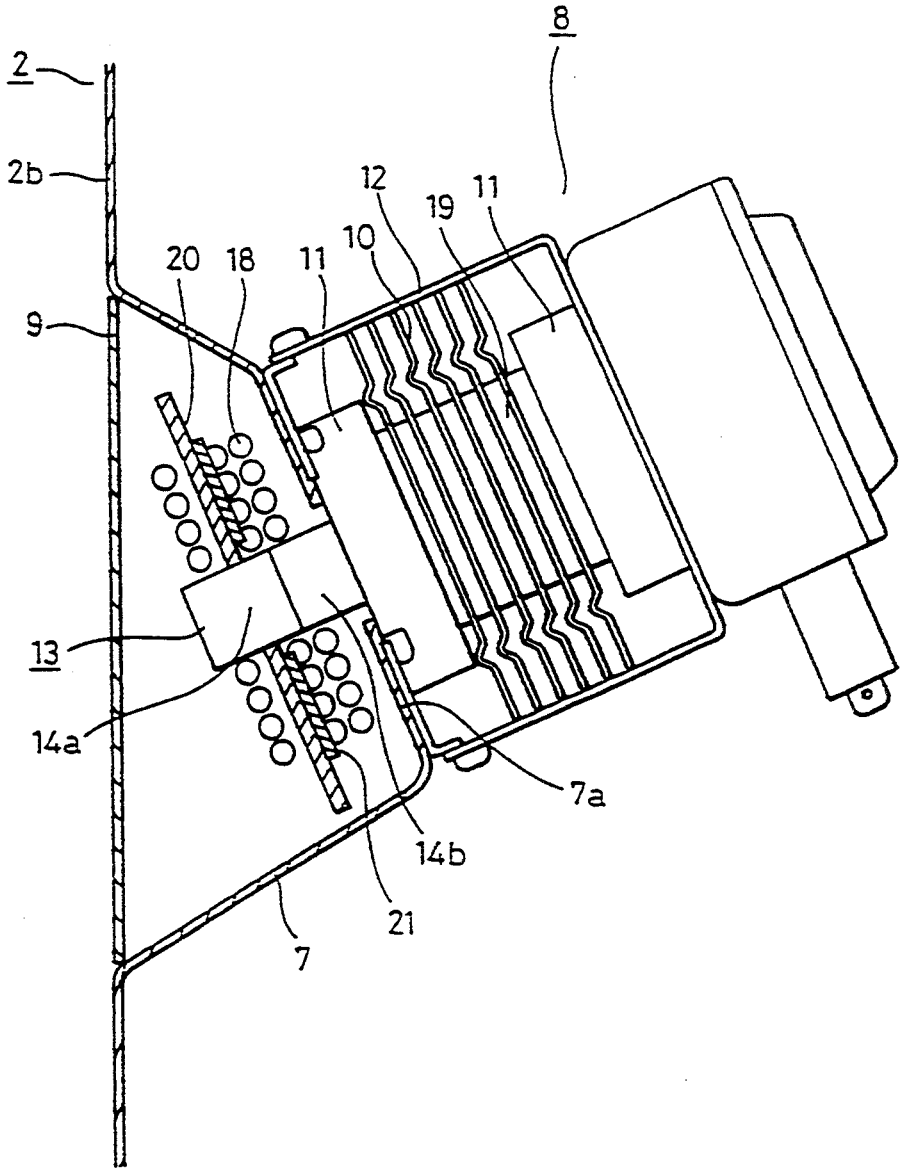
FIG. 26 is a sectional view showing the main part of one modification of the sixth embodiment of the present invention.

FIG. 26 shows a modification of the sixth embodiment of FIG. 24. The microwave oven of FIG. 26 differs from that of FIG. 24 in configuration of waveguide 7 and the attached manner of radiation antenna 21. Waveguide 7 has a sidewall in which the cross sectional area thereof becomes greater towards cavity 2 from bottom plane 7*a*. In other wards, waveguide 7 has a truncated cone configuration, similar to that of the embodiment of FIG. 24. However, bottom 7*a* of waveguide 7 is inclined by approximately 30° with respect to sidewall 2*b* of cavity 2. Radiation antenna 21 is held to be at right angles to antenna cap 14*a*, similar to the embodiment of FIG. 10.

Therefore, the microwave oven of FIG. 26 can have heating unevenness improved within cavity 2 by inclining radiation antenna 21 by approximately 30° with respect to sidewall 2*b* of cavity 2.

In the embodiments of FIGS. 24 and 26, radiation antenna 21 is held in a tilted manner so that the distance between radiation antenna 21 and sidewall 2*b* of cavity 2 becomes greater downwards. The present invention is not limited to this disposition, and radiation antenna 21 may be inclined so that the distance between sidewall 2*b* of cavity 2 and the upper portion of radiation antenna 21 is greater than the distance between sidewall 2*b* and the lower portion of radiation antenna 21.

Figure 27:
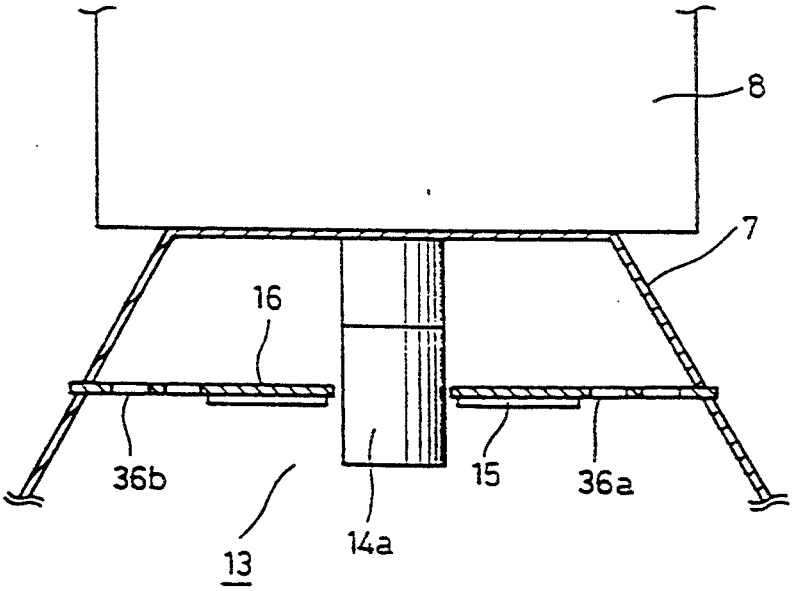
FIG. 27 is a sectional view showing the main part of a microwave oven according to a seventh embodiment of the present invention.
Figure 28:
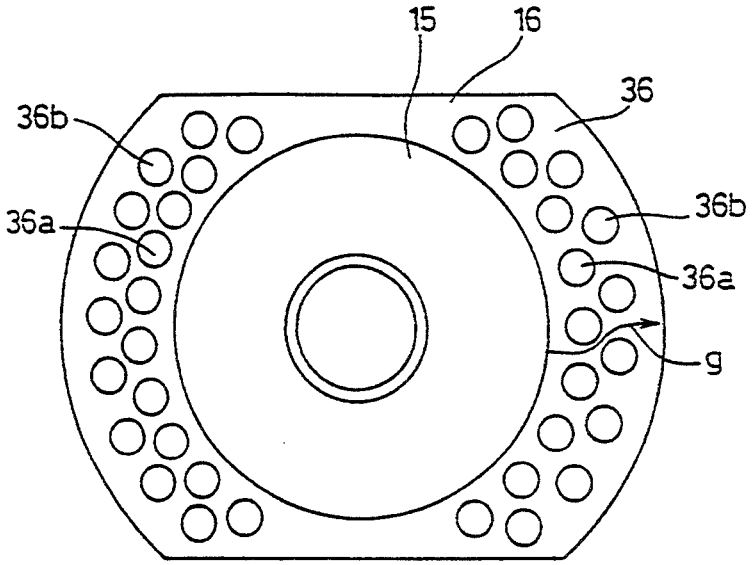
FIG. 28 is a plan view of a radiation antenna according to the seventh embodiment of the present invention.

FIG. 27 is a sectional view of the main part of a microwave oven according to a seventh embodiment of the present invention. FIG. 28 is a plan view of a fixed plate and a radiation antenna used therein. The microwave oven of the seventh embodiment is similar to the microwave oven of the first embodiment shown in FIG. 5, except that a plurality of punched hole 36 are formed at a region of fixed plate 16 between the outer periphery of radiation antenna 15 and the outer periphery of fixed plate 16. Referring to FIG. 28, a group of punched holes 36*a* formed along the outer periphery of radiation antenna 15 and a group of punched holes 36*b* formed along the outer periphery of fixed plate 16 are disposed alternately so that the center of each punched hole 36*a* corresponds to each region between two punched holes 36*b*.

When stains such as fat and juice from the food are carried into waveguide 7 from cavity 2 to adhere to fixed plate 16 to degrade the surface resistivity of the fixed plate, the provision of groups of punched holes 36*a* and 36*b* on fixed plate 16 at the periphery of radiation plate 15 will render the current flow, not through the inner space of the punched hole, i.e. not through air, but so as to meander at the surface of fixed plate 16 of low surface resistivity avoiding the punched holes, as shown by arrow g in FIG. 28. This meander of current will result in a longer path from radiation antenna 15 to waveguide 7. Because resistance is generally propagational to the path length, the surface resistivity of fixed plate 16 is increased to prevent generation of a spark.

Figure 29:
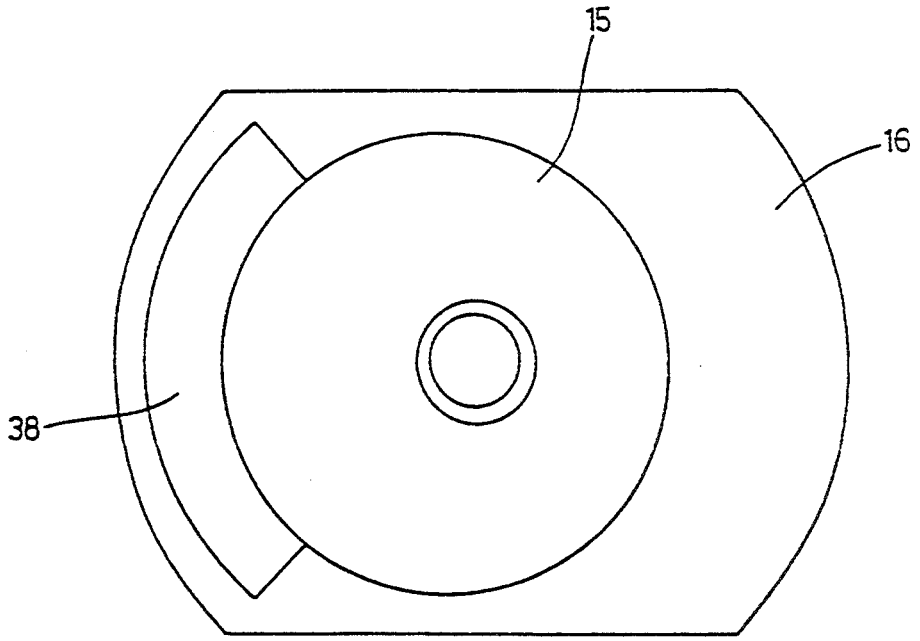
FIG. 29 is a plan view of another example of a radiation antenna according to the seventh embodiment of the present invention.

FIG. 29 is a plan view showing a modification of the embodiment of FIG. 28. Instead of a plurality of punched holes 36 as shown in FIG. 28, a slit 38 is formed in fixed plate 16 between the outer periphery of radiation antenna 15 and the outer periphery of fixed plate 16. Similar to the embodiment of FIG. 28, the current path from radiation antenna 15 to waveguide 7 crosses the air layer in slit 38, whereby resistance in the current path is significantly increased. Therefore, generation of a spark can be prevented.

In the case where the center of radiation antenna 15 is displaced from the center of fixed plate 16 as in FIG. 29, the provision of a slit 38 in a region of fixed plate 16 where the distance between radiation antenna 15 and the sidewall of waveguide 7 is short is extremely effective to prevent generation of a spark between radiation antenna 15 and waveguide 7.

According to the seventh embodiment of the present invention, the surface resistivity of the path from radiation antenna 15 to waveguide 7 is increased even if stains of food adheres to a fixed plate. Therefore, generation of a spark can be prevented.

Although the radiation antenna has been described as having a flat form in each of the aforementioned embodiments, the present invention is not limited to the radiation antenna having such flat form and the radiation antenna may have other forms such as corrugated form.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave oven comprising:

a frame, a cavity in said frame and in which a substance to be heated is accommodated, a magnetron located in a space formed between said frame and said cavity and having an output antenna for generating microwaves, a waveguide to which said magnetron is mounted, for supplying microwaves generated from said output antenna of said magnetron and radiating said microwaves into said cavity, wherein said waveguide has substantially a truncated cone configuration in which a cross sectional area at a cavity side of said waveguide is greater than a cross sectional area of said waveguide at a magnetron side of said waveguide, and said output antenna of said magnetron is disposed to project from a magnetron side of said waveguide toward said cavity, and a radiation antenna fixed in said waveguide around said output antenna of said magnetron at maintaining distances from said waveguide and said output antenna of said magnetron wherein microwaves generated from said output antenna are propagated to said radiation antenna and radiated into said cavity from said radiation antenna for preventing generation of sparks from said antennas.

2. The microwave oven according to claim 1, further comprising:

a fixed plate of a dielectric material, having an aperture substantially at the center thereof through which said output antenna of said magnetron passes, and fixed to said waveguide, wherein said radiation antenna is attached around said aperture of said fixed plate while maintaining distances from said waveguide and said output antenna of said magnetron for preventing generation of sparks.

3. The microwave oven according to claim 2, wherein the diameter of said aperture of said fixed plate is set substantially equal to the diameter of said output antenna of said magnetron.

4. The microwave oven according to claim 2, wherein the distance between an inner periphery of said radiation antenna and said output antenna of said magnetron is set to be approximately 2 mm.

5. The microwave oven according to claim 2, wherein a plurality of vent holes are provided at a sidewall of said waveguide, parallel to said fixed radiation antenna.

6. The microwave oven according to claim 2, wherein said radiation antenna is attached around said aperture on a cavity side surface of said fixed plate.

7. The microwave oven according to claim 6, wherein said radiation antenna has a portion bent to at least one of said cavity side and said magnetron side.

8. The microwave oven according to claim 2, wherein said radiation antenna is attached around said aperture on a magnetron side surface of said fixed plate.

9. The microwave oven according to claim 8, wherein said radiation antenna has a portion bent to at least one of said cavity side and said magnetron side.

10. The microwave oven according to claim 2, wherein an opening is provided on an area of said fixed plate between the outer periphery of said radiation antenna and the outer periphery of said fixed plate at a position in which a straight current path on said radiation antenna is not generated.

11. The microwave oven according to claim 10, wherein said opening comprises a plurality of punched holes.

12. The microwave oven according to claim 11, wherein said opening includes a longitudinal slit.

13. The microwave oven according to claim 1, wherein said radiation antenna has a portion bent to at least one of said cavity side and said magnetron side.

14. The microwave oven according to claim 1, wherein said radiation antenna has an aperture at a position off the center thereof through which said output antenna of said magnetron passes.

15. The microwave oven according to claim 1, further comprising a fixed plate of a dielectric material for fixing said radiation antenna to a top portion of said antenna of said magnetron at a position displaced from the center of said radiation antenna.

16. The microwave oven according to claim 1, wherein said radiation antenna has an aperture through which said output antenna of said magnetron passes, and a rib provided along an entire perimeter of said aperture, substantially parallel to said output antenna.

17. The microwave oven according to claim 1, wherein said radiation antenna is fixed parallel to a sidewall of said cavity.

18. The microwave oven according to claim 1, wherein said radiation antenna is fixed inclined towards a sidewall of said cavity.

19. The microwave oven according to claim 18, wherein said magnetron side bottom of said waveguide is fixed inclined with respect to a sidewall of said cavity, wherein said radiation antenna is fixed perpendicular to said output antenna and parallel to said bottom.

20. The microwave oven according to claim 1, wherein said radiation antenna has a flat form.

* * * * *